United States Patent [19]

Milbocker

[11] Patent Number: 4,657,712

[45] Date of Patent: Apr. 14, 1987

[54] HUMIDIFIER

[76] Inventor: Daniel C. Milbocker, 5397 Challedon Dr., Virginia Beach, Va. 23462

[21] Appl. No.: 833,676

[22] Filed: Feb. 25, 1986

Related U.S. Application Data

[63] Continuation of Ser. No. 506,217, Jun. 21, 1983, abandoned.

[51] Int. Cl.[4] ..... B01F 3/04

[52] U.S. Cl. ..... 261/90; 239/7; 239/8; 239/225.1

[58] Field of Search ..... 261/88-90, 261/30; 239/2 S, 7, 8, 14, 77, 78, 225, 568

[56] References Cited

U.S. PATENT DOCUMENTS

| | | | |
|---|---|---|---|
| 2,079,117 | 5/1937 | Hays | 261/90 X |
| 2,083,787 | 6/1937 | Leffler | 261/88 |
| 2,176,174 | 10/1939 | Gelakoski | 261/88 X |
| 2,419,598 | 4/1947 | Schey et al. | 261/90 |
| 2,512,782 | 6/1950 | Strickland | 239/225 X |
| 2,566,319 | 9/1951 | Deacon | 261/88 X |
| 2,688,376 | 9/1954 | Gilliam | 261/90 X |
| 2,734,771 | 2/1956 | King, Jr. | 261/90 X |
| 2,738,177 | 3/1956 | Carle | 261/90 |
| 2,750,708 | 6/1956 | Handfield | 239/77 X |
| 3,326,607 | 6/1967 | Book | 239/7 X |
| 3,434,654 | 3/1969 | Feller | 261/88 X |
| 3,584,786 | 6/1971 | Johnson | 239/568 |
| 3,731,517 | 5/1973 | Johnson | 72/367 |
| 3,737,101 | 6/1973 | Johnson | 239/225 |
| 3,744,773 | 7/1973 | Velander | 261/88 |
| 3,861,891 | 1/1975 | Noguchi et al. | 261/90 X |
| 3,878,989 | 4/1975 | Jenkins | 239/77 |
| 4,174,362 | 11/1979 | Rahman | 261/90 |
| 4,202,496 | 5/1980 | Vanderkelen et al. | 239/14 |
| 4,278,617 | 7/1981 | Rahman | 261/90 X |

FOREIGN PATENT DOCUMENTS

| | | | |
|---|---|---|---|
| 565988 | 4/1930 | Fed. Rep. of Germany | 261/90 |
| 610589 | 3/1935 | Fed. Rep. of Germany | 261/90 |
| 1041134 | 10/1953 | France | 261/88 |
| 162678 | 5/1921 | United Kingdom | 261/88 |
| 642596 | 1/1979 | U.S.S.R. | 261/88 |

*Primary Examiner*—Richard L. Chiesa
*Attorney, Agent, or Firm*—A. W. Breiner

[57] ABSTRACT

This invention relates to a humidifier which includes a multi-bladed fan which is rotated at a high speed. The blades have flow passages extending therethrough and opening out through their end tips. Liquid is supplied to the center of the fan and distributed to the radiating flow passages. The speed of the blades is such that the liquid is forced through the flow passages in the blade centrifugally so as to produce droplets at the tips of the blade. The droplets are reduced in size by the shear forces of the blade tip passing through the air. The fan maintains the end tip vortex wherein as the droplets appear at the radial ends of the blades, the droplets are drawn rearwardly around the ends of the blades tips and then back through the blades so as to be further reduced in size by shear forces. The rate of fog production is controlled by a flow meter.

19 Claims, 5 Drawing Figures

HUMIDIFIER

This is a continuation of application Ser. No. 506,217 filed June 21, 1983 now abandoned.

This invention relates in general to new and useful improvements in humidifiers, and more particularly to a high volume humidifier which will effectively produce a fog and distribute the fog over a large area.

Most particularly, this invention relates to a humidifier for use in association with ventilated high humidity propagation although the humidifier has usage in conjunction with food processing (dehydration), flue smoke cleaning and cooling, greenhouse and poultry house cooling, and high humidity warehouse storage of nursery stock, vegetables and fruits.

This invention particularly relates to a high-volume humidifier which is of an extremely simple construction and which is efficient to operate.

The humidifier is free of separate liquid distributing devices, relying solely upon centrifugal force to distribute the liquid. The liquid is supplied at the tips of the blades of a fan where small droplets are produced by the shear forces of the fan tip passing through the air. The droplets are carried in the vortex of air at the blade tips, drawn rearwardly, and returned through the blades into the air flow and dispersed by shear forces into still smaller droplets as fog.

The humidifier in accordance with this invention includes a multi-blade fan wherein the blades preferably are of an airfoil cross section and have formed therein fluid passages which open through the tips of the blades. The supply of liquid to the fan is controlled by means of a meter and the supply quantities are always less than that of the capacity of the passages through the blades. In this manner, although the liquid is supplied to the fan under pressure, the liquid is distributed from the tips of the blade by centrifugal force, perpendicular to the direction of blade movement, thereby producing the shear force necessary for breaking the delivered liquid into small droplets. Because the flow is into the center of the fan, and since the flow through the blades is by way of centrifugal force, no pressure type connections are required between the liquid supply and the fan, nor are nozzles required to break up the liquid into the required droplet size. Thus, the humidifier is free from the customary clogging.

Having described the invention in general terms, specific and presently preferred embodiments will be set forth in the context of the illustrative drawing.

Figure 1:
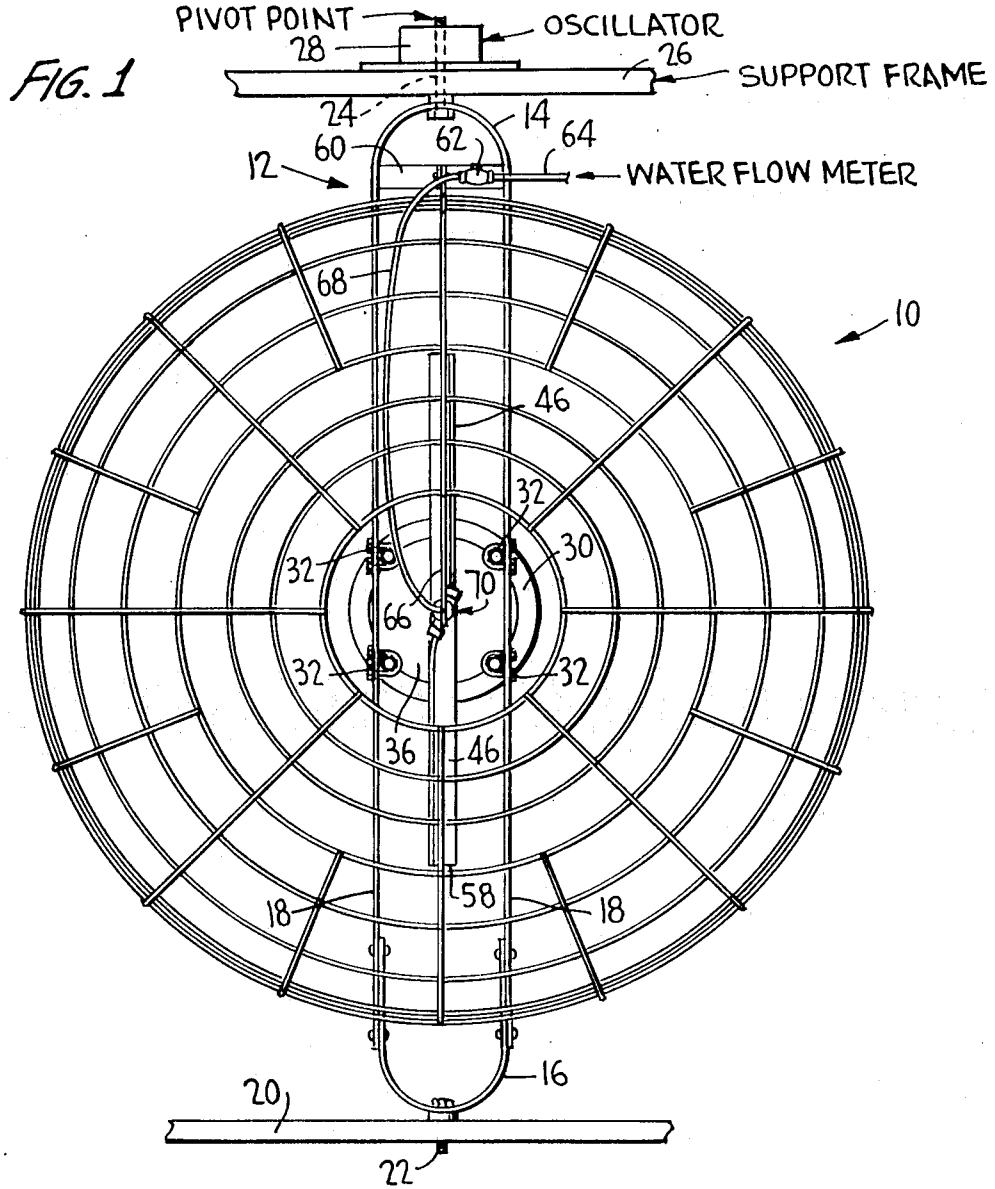
FIG. 1 is a front elevational view of the humidifier and illustrates a general construction thereof.

Referring now to the drawings in detail, reference is first made to FIG. 1 wherein the general details of the humidifier, which is identified by the numeral 10, are illustrated. First of all, it is pointed out here that the humidifier 10 includes a support, generally identified by the numeral 12. The support 12 includes an upper, generally U-shaped bracket 14 extending to a lower generally U-shaped bracket 16 which are on alignment with each other and which are connected together. The brackets 14, 16 may be provided with suitable means to affix the same on support frame members or the humidifier may be of the type which includes an oscillator. In the illustrated form of the invention, the support frame 12 is primarily supported by a lower support frame member 20 by way of a mounting pin 22 projecting downwardly from the bracket 16.

The bracket 14 also carries a mounting pin 24 which extends upwardly through an upper support frame 26. The upper end of the pin 24 is secured to a conventional oscillator 28 for effecting the controlled oscillation of the support frame 12.

In the preferred embodiment of the invention, the support frame 12 carries at the center thereof an end or front mounted motor 30 which is secured to the straps 18 by sets of brackets 32. The motor 30 is preferably a 3450 RPM motor. Good results have been obtained with a ¾ HP motor. A humidifier driven by such a motor and formed in accordance with my invention will distribute thirty gallons per hour of fine quality fog at a velocity measured at the fan of thirty miles per hour.

Figure 2:
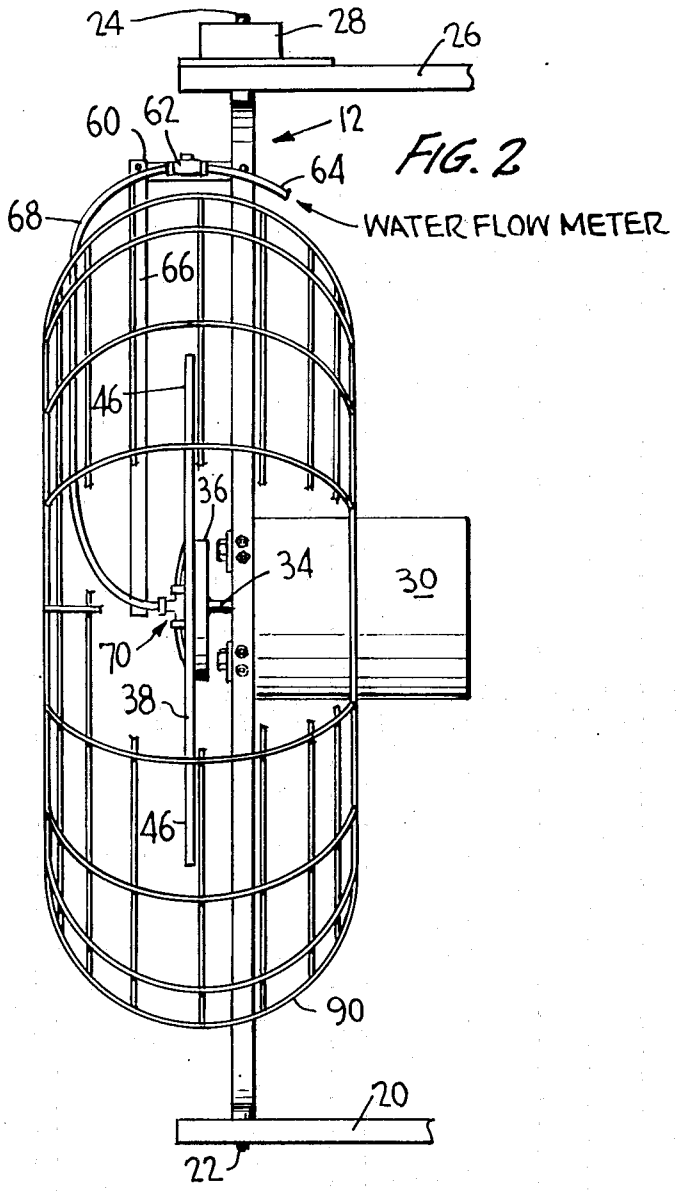
FIG. 2 is a side elevational view of the humidifier and further illustrates the details thereof.
Figure 3:
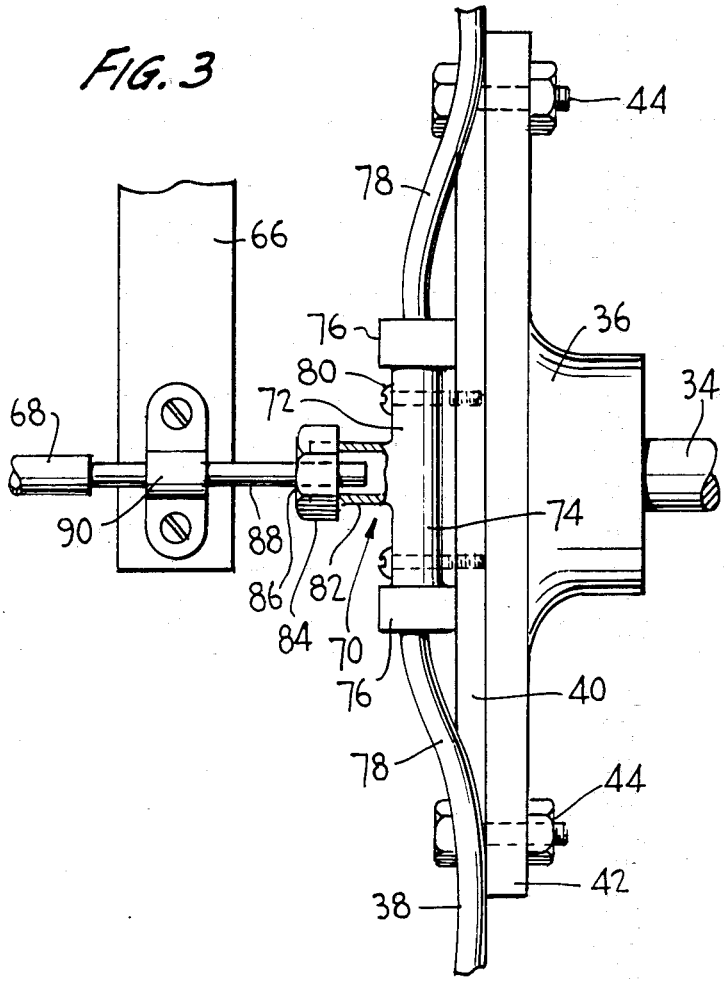
FIG. 3 is an enlarged fragmentary vertical sectional view of the hub and related assembly of FIGS. 1 and 2 and illustrates the specifics of the liquid supply.

Referring particularly to FIG. 3, it will be seen that the motor 30 (FIG. 2) has a motor shaft 34 which is provided with a hub 36 on the free end thereof. The hub 36 which includes a flat central portion 40 carries a fan 38. The fan is secured to the flat central portion 40 by two guide pins and secured to hub 36 by means of a suitable nut and bolt arrangement 44.

Figure 4:
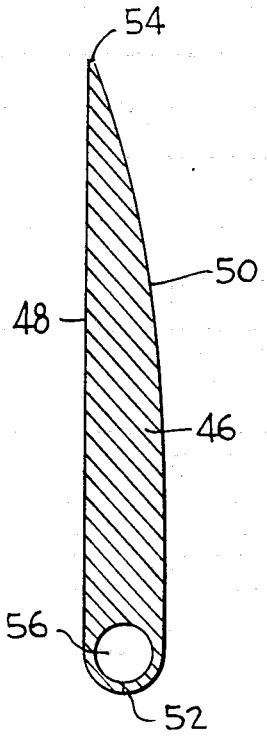
FIG. 4 is an enlarged fragmentary sectional view taken through one of the blades and illustrates a cross-section thereof.
Figure 5:
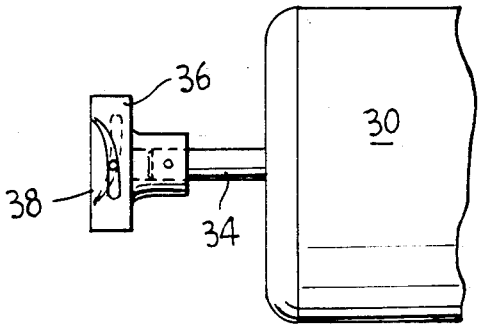
FIG. 5 is a fragmentary elevational view of the fan showing generally the position and pitch of the blade.

Although the fan 38 may have more than two blades, in the illustrated embodiment of the invention, the fan has but two blades 46. Each blade 46, as is best shown in FIG. 4, is an airfoil cross-section including a generally flat or concave face 48 and a conve face 50. The leading edge of the blade 46 is rounded as in 52 and tapers to a sharp tip 54.

In the simplest form of blade construction, the forward part of the blade is relieved by way of a simple milling operation, and then the tip portions are rounded together so as to define a water passage 56 which extends from within the hub the full length of the blade and freely opens out of the tip or radial end 58 (FIG. 1) of the blade.

Reference is now made to FIG. 2 wherein it will be seen that there projects from the upper part of the support frame 12 a forwardly projecting bracket 60. The bracket 60 carries a water flow meter 62 which is of a conventional adjustable type and which is supplied with a supply line 64 which may be in the form of a simple garden hose. Preferably the flow meter will be mounted on the frame.

A strap member 66 depends from the forward part of the bracket 60 and supports the lower end of a supply line 68 which leaves from the flow meter 62 and extends to the fan 38. Alternatively, the guard is made in two pieces. The strap 66 will then extend vertically as in FIG. 2 but down the face of the guard. The ends follow the inner curvature of the guard and are used to fasten both halves of the guard together. Where the strap 66 extends across the opening, it is twisted ninety degrees to reduce wind friction.

Referring once again to FIG. 3, it will be seen that there is mounted on the front of the central fan portion 40 a conventional tee fitting 70. The tee fitting 70 has legs 72, 74 which extend in opposite directions and which are provided at their free ends with conventional tubing fittings 76 through which tubing 78 extends in sealed relation, the tubing 78 leading into the passages 56 within the blades 46.

The tee fitting 70 is secured to the fan central portion 40 by means of fasteners 80 which extend through the legs 72, 74 and are threaded into the fan central portion 40.

The tee fitting 70 also includes a forwardly extending leg 82. The leg 82 is axially aligned with the motor shaft 34 and carries at the end thereof a conventional fitting 84 having an enlarged opening 86 therethrough. The opening 86 is of a diameter corresponding generally to the internal diameter of the leg 82.

The supply line 68 terminates immediately adjacent and in front of the depending support or strap 66 and has connected thereto in liquid type relation a supply tube 88. The supply tube 88 is received in a mounting clamp 90 carried by the lower part of the support 66 and extends coaxially with the axis of the shaft 34 and freely into the leg 82. As will be described hereinafter, no seal is required between the supply tube 88 and the tee fitting 70.

For protective purposes, there is provided a suitable guard 90 (FIG. 2) which may be of any desired construction. The illustrated guard 90 is formed of wire and completely surrounds in space relation the fan 38, providing ample radial clearance from the tips of the blades 46. The guard is closed at the back, closely surrounding the motor 30, but is open at the front.

As previously described, the humidifier 10 is capable of an output of thirty gallons per hour. Accordingly, the flow meter 62 will have this capability or greater. In operation, the motor 30 is started and the fan 38 is brought up to the desired speed. Then water is supplied to the tee fitting 70 by properly adjusting the flow meter 62. The water flows under pressure into the tee fitting 70. There is no leakage in that at the 3450 RPM speed of the motor 30 the centrifugal action of the blades 46 through the liquid passages or conduits 56 formed therein will apply centrifugal force to the water entering into the legs 72, 74 of the tee fitting to the extent that there will be negative pressure in the tee fitting and therefore no pressure escape of the supplied water.

The tip speed of the blades 46, in accordance with the diameter of the fan 38, should be at a minimum on the order of 13,000 feet per minute. However, this speed may be increased with fog generation being improved by more power to produce tip speeds on the order of the speed of sound.

It has been found that the cross-section of the flow passages 56 may be of over capacity size without it being detrimental to the production of fog. On the other hand, the centrifugal force action of flinging the water from the tips of the blades 46 will produce fine droplets.

Most particularly, it has been found that the water droplets exiting from the tips of the blades 46, instead of continuing radially outward from the blades, are drawn to the rear behind the fan 38 by vortex currents common on high speed fans and then through the blades 46 so that the already fine droplets are reduced in size by shear force as they pass through the blades 46. The net result is a fine mist or fog.

Although only a two-bladed fan has been specifically illustrated and described, three- and four-bladed fans have been successfully utilized but require more power to operate at the required tip speed.

Experimentation has also been made with respect to the blade pitch. It has been found that a pitch on the order of four to seven degrees provides satisfactory results.

Although a preferred embodiment of the humidifier has been specifically illustrated and described herein, it is to be understood that minor variations may be made in the humidifier without departing from the spirit or scope of the invention as defined by the appended claims.

It is claimed:

1. A humidifier comprising a bladed fan including at least two blades, each of said blades having a liquid passage closed through the entire length and terminating at the outermost free end of each blade with an opening of generally the same dirension as said liquid passage, drive means for rotating said fan about an axis to generate an air flow, means for supplying a liquid to said liquid passages generally from the center of said fan; the axial length of each blade, the speed of rotation of said fan, and the pitch of each blade being such that droplets of the liquid are directed out of said liquid passage and then drawn around and through said fan to vaporize said liquid droplets and distribute the same with said air flow from said fan in an open unconfined and unobstructed environment relative to the air and liquid flow.

2. A humidifier according to claim 1 wherein there are meter means for controlling the flow of liquid to said blades at a rate no greater than the rate at which a liquid can flow through said liquid passages under the influence of centrifugal force wherein the liquid is discharged as droplets as opposed to being discharged as a stream.

3. A humidifier according to claim 2 wherein the liquid supply rate is positively less than the centrifugal flow rate through said liquid passages.

4. A humidifier according to claim 1 wherein each fluid passage extends within the confines of a respective blade.

5. A humidifier according to claim 4 wherein each blade has a tip, and each fluid passage freely opens through the tip of an associated blade.

6. A humidifier according to claim 1 wherein said blades have a tip speed on the order of at least 13,000 feet per minute.

7. A humidifier according to claim 1 wherein said blades have a tip speed on the order of at least 13,000 feet per minute, and a pitch on the order of 4 to 7 degrees.

8. A humidifier according to claim 1 wherein each blade has an airfoil cross section.

9. A humidifier according to claim 1 wherein said means for supplying liquid includes a fixed feed line centered on said blade, a receptacle carried by said blade, said feed line freely entering said receptacle and freely terminating therein.

10. A humidifier according to claim 9 wherein there is a negative pressure within said receptacle during the rotation of said fan.

11. A humidifier according to claim 1 wherein said humidifier is free of mechanical liquid flow direction changing means radiating outwardly to the free end of said blades.

12. A method of humidifying comprising the steps of rotating a fan having plural blades to generate an air flow, each of said blades having a liquid passage closed through its entire length and terminating at the outermost free end of said blade with an opening of generally the same dimension as said liquid passage, supplying liquid to the center of the fan and distributing the liquid in the form of droplets from said free opening liquid passage at the tip of each blade, and using the fan to draw the distributed liquid droplets around behind the fan and through the fan wherein the fan breaks up the distributed liquid droplets and forces the same forward together with said air flow in an open unconfined and unobstructed environment relative to the air and liquid flow.

13. A method according to claim 12 wherein the liquid is directed to each blade tip by centrifugal force and is distributed in the form of droplets.

14. A method according to claim 13 wherein the liquid is supplied to the fan at a rate less than the centrifugal capacity of the blades.

15. A method according to claim 13 wherein the liquid is supplied to the fan at a rate less than the centrifugal capacity of the blades, and the liquid is freely delivered from a source to the center of the blade.

16. A method according to claim 15 wherein the liquid delivered to the center of the blade is delivered at a positive pressure.

17. A method according to claim 12 wherein said fan functions as the sole means for drawing the distributed liquid behind the fan.

18. A method according to claim 12 wherein said blades have a tip speed on the order of at least 13,000 feet per minute.

19. A method according to claim 12 wherein said blades have a tip speed on the order of at least 13,000 feet per minute and a pitch on the order of 4 to 7 degrees.

* * * * *